United States Patent [19]

Chatterson

[11] Patent Number: 4,648,527

[45] Date of Patent: Mar. 10, 1987

[54] COMPRESSOR UNIT FOR FILING UNIT

[75] Inventor: Louis M. Chatterson, Kentwood, Mich.

[73] Assignee: Haworth, Inc., Holland, Mich.

[21] Appl. No.: 733,677

[22] Filed: May 10, 1985

[51] Int. Cl.[4] ..... B65D 25/06

[52] U.S. Cl. ..... 220/22.4

[58] Field of Search ..... 220/22.1, 22.2, 22.4, 220/22.5, 22.6

[56] References Cited

U.S. PATENT DOCUMENTS

| | | | |
|---|---|---|---|
| 1,116,757 | 11/1914 | Stuck | 220/22.4 |
| 1,438,385 | 12/1922 | Lehman | 220/22.5 |
| 1,574,526 | 2/1926 | Yerser | 220/22.5 |
| 1,805,322 | 5/1931 | Welk | 220/22.5 |
| 1,898,533 | 2/1933 | Harriman | 220/22.5 |
| 2,081,470 | 5/1937 | Vanderhoof | 220/22.4 |

FOREIGN PATENT DOCUMENTS

| | | | |
|---|---|---|---|
| 216272 | 5/1924 | United Kingdom | 220/22.1 |

*Primary Examiner*—George E. Lowrance

*Attorney, Agent, or Firm*—Flynn, Thiel, Boutell & Tanis

[57] ABSTRACT

A compressor unit for a file unit, wherein there is provided a compressor body which has a substantially vertical plate part which extends partially across the file unit and is positionable adjacent the rear of a row of documents. The compressor body mounts thereon a brake plate which is slidably accommodated within a confined channel which extends longitudinally along a wall of the file unit. A pressure plate is slidably mounted on the compressor body and has a foot portion which overlies the brake plate so that braking flanges as associated with the fixed channel are interposed therebetween. A manually-releasable compression linkage is movably mounted on the compressor body and has wedging surfaces which cooperate with the pressure plate for causing the pressure plate and brake plate to be moved toward one another to frictionally grip the braking flanges therebetween.

13 Claims, 4 Drawing Figures

COMPRESSOR UNIT FOR FILING UNIT

FIELD OF THE INVENTION

This invention relates to an improved compressor unit for a filing unit such as a shelf or drawer.

BACKGROUND OF THE INVENTION

File shelves or drawers conventionally utilize a compressor unit for assisting in maintaining documents in an upright position, particularly when the file unit is only partially filled with documents. The known compressor units typically employ a vertically enlarged compressor plate which is positioned adjacent the rear of the stack of documents, which plate in turn mounts thereon a manually-releasable mechanism to releasably hold the plate in a selected position longitudinally along the file unit. The compressor mechanism in many instances employs one or more latching members which cooperate with a rack which is secured to the file drawer, such as along the sides or the bottom thereof, to securely hold the compressor plate in its selected position. While such compressor units do perform in a satisfactory manner, nevertheless such units require that the drawer or shelf be provided with one or two elongated racks extending longitudinally therealong, which racks are either integrally formed in the wall of the file unit or are formed in a separate member which is then fixedly secured thereto. This hence increases the overall cost and complexities of the file unit. Further, such compressor units are generally noisy to operate since often times they can be slid rearwardly without being released, and hence create a loud ratcheting sound.

This invention relates to a compressor unit which is believed to represent a significant improvement over the compressor units which are conventionally utilized at the present time. More specifically, the compressor unit of the present invention is effective solely by means of a frictional holding force being created between the compressor unit and the file unit so as to maintain the compressor unit in its selected position. The file unit can hence be manufactured without utilizing ratchets or racks, whereby the file unit can be manufactured more economically, and at the same time the compressor unit can be infinitely positioned at any location longitudinally of the file unit and operates quietly and smoothly when activated.

In the improved compressor unit of this invention, there is provided a compressor body which has a substantially vertical plate part which extends partially across the file unit and is positionable adjacent the rear of the row of documents. This compressor body mounts thereon a braking or holding plate which is slidably accommodated within a confined channel which extends longitudinally along a wall of the file unit. A pressure plate is slidably mounted on the compressor body and has a foot portion which overlies the holding plate so that braking flanges as associated with the fixed channel are interposed therebetween. A manually-releasable compression linkage is movably mounted on the compressor body and has wedging surfaces which cooperate with the pressure plate for causing the pressure plate and brake plate to be moved toward one another to frictionally grip the braking flanges therebetween.

In the improved compressor unit of the present invention, the complete mechanism is totally enclosed so as to provide a unit which is not only desirable in appearance but which is also safe to operate.

Other objects and purposes of the invention will be apparent to persons familiar with structures of this general type upon reading the following specification and inspecting the accompanying drawings.

Figure 1:
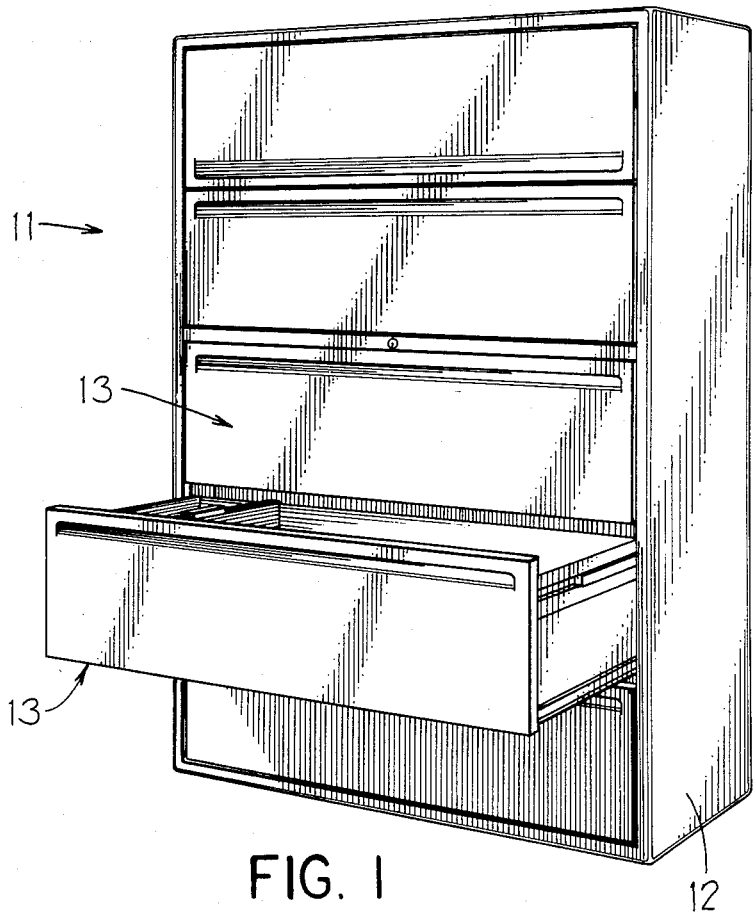
FIG. 1 is a perspective view of a lateral file cabinet which mounts a plurality of slidable file drawer unit, which drawer units incorporate therein the improved compressor unit of this invention.
Figure 3:
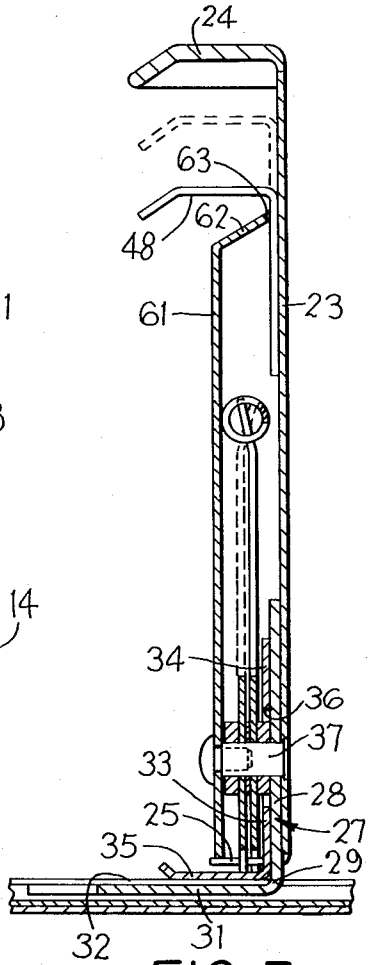
FIG. 3 is a sectional view of the compressor unit as taken substantially along line III—III in FIG. 2.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the compressor unit and designated parts thereof. Said terminology will include the words specifically mentioned, derivatives thereof, and words of similar input.

DETAILED DESCRIPTION

Referring to the drawings, there is illustrated a file cabinet 11 of the type commonly referred to as a lateral file. This cabinet 11 includes a housing 12 in which is slidably supported a plurality of file drawer units 13.

Figure 2:
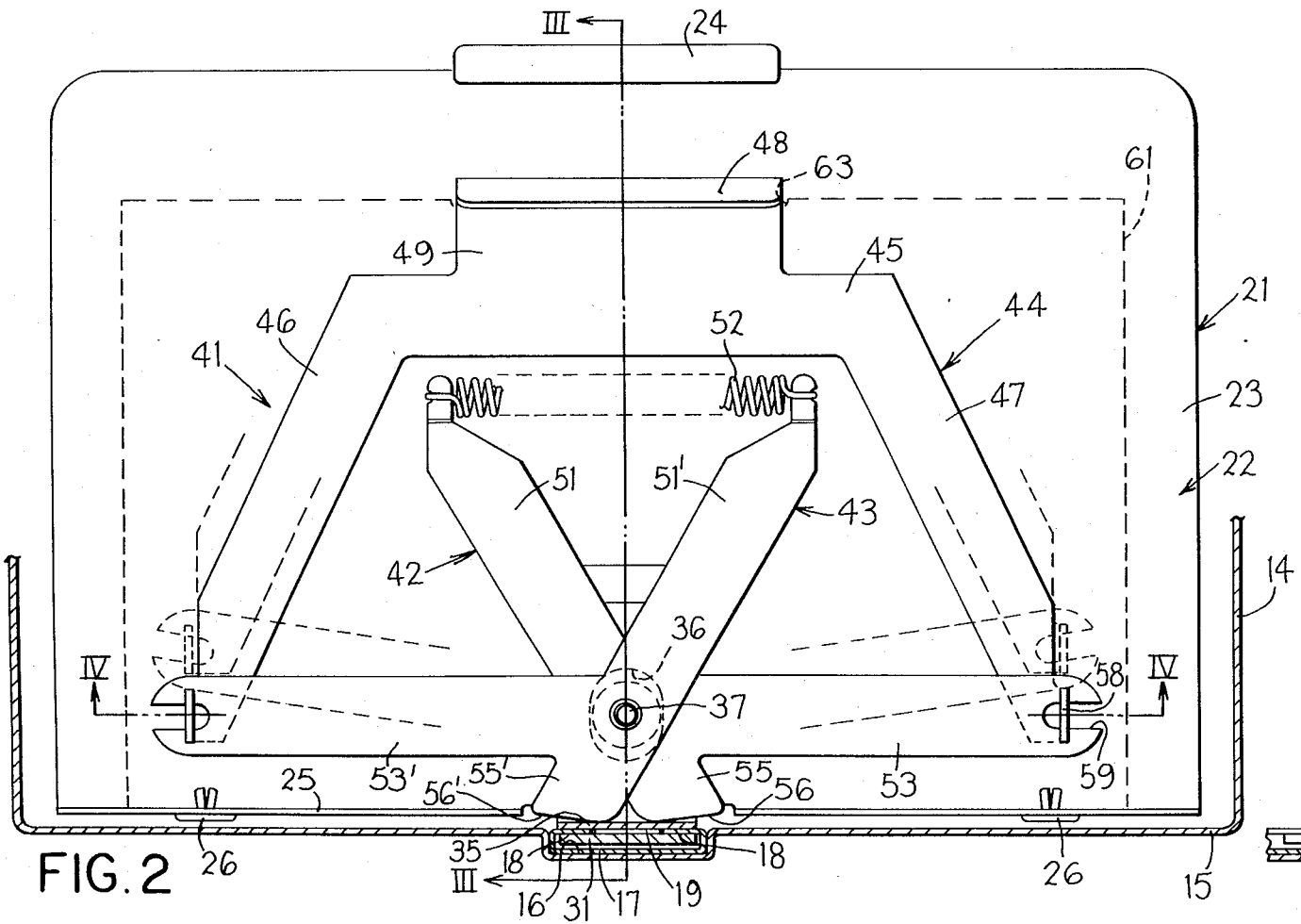
FIG. 2 is a cross-sectional elevational view through a typical file drawer unit so as to illustrate the compressor unit.
Figure 4:
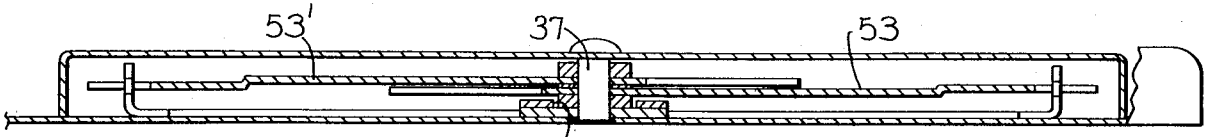
FIG. 4 is a sectional view taken substantially along the line IV—IV in FIG. 2.

The file drawer unit 13, in the illustrated embodiment of FIG. 2, has a channel-like cross-section formed by opposed sidewalls 14 joined together by a bottom wall 15. The bottom wall 15, adjacent the longitudinally extending center thereof, is provided with a longitudinally extending depression 16. A channel member 17 is positioned within this depression 16 and is fixedly secured relative to the bottom wall 15, as by welding or bolting. The channel member 17 has a pair of inwardly directed top flanges 18 which are substantially coplanar with the main part of the bottom wall 15. These top flanges 18 extend longitudinally of the file drawer unit and are spaced apart by a narrow longitudinally extending slot 19 therebetween. This slot 19 provides communication with the interior channel of the channel member 17.

To maintain a row of files or documents in an upright position within the drawer unit 13, the present invention provides a compressor unit 21 which is slidable longitudinally of the drawer unit and lockable in any selected position therealong so as to support the rear side of the row of documents. This compressor unit 21 includes a compressor body 22 which is provided with a main substantially vertically oriented support plate 23 which is sized so as to occupy a substantial extent of the transverse cross-section of the drawer unit. This main support plate 23 has a hooklike handle 24 which projects rearwardly from the upper edge thereof substantially along the center part of the support plate. There is further provided a foot part 25 which is fixedly, here integrally, connected to the lower edge of the support plate 23 and projects rearwardly therefrom so as to overlie the bottom wall 15. This foot part is of only a short extent in the longitudinal direction of the drawer unit, and is provided with a pair of sidewardly spaced glides 26 fixed thereto so as to be slidably engageable with the bottom wall 15 when the compressor unit is in a released position.

The compressor body 21 also has a brake or holding member 27 fixed thereto. This member 27 is substantially L-shaped and includes a vertical plate part 28 which overlies the rear side of the main support plate 23 and projects downwardly therefrom. This vertical plate part 28, at its lower end, merges with a reduced width neck part 29 which protrudes downwardly through the slot 19 and then merges into a horizontally projecting leg or holding plate 31. This holding or brake plate 31 is of increased width so as to substantially occupy the complete width of the channel within the channel member 17, and is also of substantial longitudinal length within the channel. The plate 31 defines, on the upper surface 32 thereof, braking areas which are adapted to contact the undersides of the flanges 18 when the compressor unit is in the activated position illustrated by FIG. 2. However, when the compressor unit is released or deactivated, then the compressor body moves downwardly causing the brake plate 31 to move downwardly out of engagement with the flanges 18.

The brake plate 31 is provided so as to cooperate with an L-shaped pressure member 33, the latter being mounted on the compressor body 22 so as to permit limited slidable displacement therebetween in a vertical direction. This L-shaped pressure member 33 includes a vertical plate part 34 which overlies the vertical part 28 and is slidable relative thereto. This vertical plate part 34 is fixedly, here integrally, joined to a lower horizontally extending leg 35 which functions as a pressure plate. This pressure plate 35 is disposed directly over but spaced upwardly from the brake plate 31 due to the presence of the flanges 18 therebetween, whereby the pressure plate 35 is hence slidably supported on these flanges 18 for displacement in the longitudinal direction of the drawer unit. This pressure plate 35, at its free edge, is preferably bent upwardly so as to facilitate the free slidable displacement of the pressure plate. To accommodate the relative vertical displacement, the vertical plate part 34 has a vertically elongated slot 36 formed therein, through which slot projects a horizontally-directed guide pin 37 which is fixed to and projects rearwardly from the main support plate 23.

To activate the compressor unit 21, there is provided a compression mechanism 41 which includes a pair of swingable compressor links 42 and 43 which are joined to a release member 44.

The release member 44 is formed substantially as a downwardly-opening channel-like member having a top bar 45 provided with a pair of side legs 46 and 47 projecting downwardly from the opposite ends thereof. A hooklike handle 48 projects rearwardly from the upper edge of the top bar 45 substantially at the center thereof, whereby this handle 48 is hence spaced downwardly from the aforementioned handle 24.

The compressor link 42 is formed substantially as a three-armed lever which effectively pivots about the guide pin 37. For this purpose, the link 42 has a central part which is effectively hinged on the guide pin 37, and a first elongate arm 51 projects upwardly from the hinge defined by pin 37. This first arm 51, adjacent its free end, is joined to one end of a coil-type tension spring 52. A second elongate arm 53 projects outwardly from the hinge substantially in a sideward horizontal direction, which arm 53 at its free end is joined by a hinge to the lower free end of the side leg 47. The link 42 has still a third but short arm 55 which projects outwardly from the hinge 37. This short arm 55 which projects primarily downwardly and, at its lower end, defines thereon a curved compression surface 56 which is adapted to transversely slidably engage the upper surface of the pressure plate 35.

The hinge between the elongate arm 53 and the leg 47 is formed by means of a transverse tab 58 as formed on the side leg being accommodated within an elongated groove 59 which opens inwardly of the arm 53 so as to permit limited slidable displacement therebetween as required by the pivoting of the compressor link 42.

The other compressor link 43 is structurally and functionally substantially identical to the compressor link 42 but is substantially reversely oriented, and hence the parts thereof have been designated by the same reference numerals but with the addition of a prime (′) thereto.

The curved compression surface 56 (and its counterpart 56′) is, at its inside corner, of minimal radius as measured from the axis of hinge 37. However, the radius of surface 56 as generated about the axis of hinge 37 gradually increases as the surface 56 extends toward its outer edge (rightwardly in FIG. 2). Hence, as arm 55 swings (clockwise in FIG. 2) towards a vertical position, the surface 56 exerts an increasing downward clamping pressure against the pressure plate 35.

The tension spring 52 acts between the arms 51, 51′ tending to continually bias the links 42 and 43 in opposite rotational directions, whereby the short arms 55, 55′ are continuously biased toward one another and toward vertical positions so that the curved compression surfaces 56 and 56′ are hence continuously urged into wedging engagement with the pressure plate 35 tending to urge the latter downwardly against the flanges 18.

As is apparent from FIG. 2, the short arm 55 is substantially aligned with but on the opposite side of the hinge axis from the first elongate arm 51. Further, the first and second arms 51 and 53 normally define therebetween an angle which exceeds 90°.

To protectively enclose the compression mechanism 41, there is provided a vertically enlarged cover plate 61 which is spaced rearwardly from and substantially parallel with the main support plate 23 so as to enclose the mechanism 41 therebetween. This cover plate 61 has a lower edge thereof positioned on the foot part 25 adjacent the free-edge thereof, and the upper part 62 of the cover plate 61 is tapered inwardly so as to abut the rear surface of the support plate 23. Plates 61 and 23 are held together by screws (not shown). The upper edge of the cover plate 61, however, in the central part thereof, is provided with an elongated shallow slot guide or recess 63 so as to permit the handle extension 49 to slidably project upwardly.

The compressor body 22, cover 61, release member 44, links 42 and 43, and pressure member 33 are all preferably formed from thin metal plate.

OPERATION

The operation of the compressor unit 21 will be briefly described to ensure a complete understanding thereof.

The compressor unit 21 will normally be maintained in its activated or braked position illustrated by FIG. 2, in which position the unit is frictionally engaged and hence stationarily held in a selected position longitudinally of the file drawer unit. When in this holding or activated position, the spring 52 pulls the arms 51, 51' toward one another so that the short arms 55, 55' also are urged toward one another, thereby causing the curved compression surfaces 56, 56' to swing toward one another and hence exert a downward force against the pressure plate 35. Since this pressure plate 35 is free to slide vertically relative to the compressor body 22, this hence causes the pressure plate 35 to firmly engage the upper surfaces of the flanges 18. The effect of the spring, however, still continues to cause downward pressure of the surfaces 56, 56' against the pressure plate 35, and hence the reaction causes the complete compressor body 22 to lift upwardly away from the bottom wall 15, and this in turn causes the brake plate 31 to raise upwardly to engage the underside of the flanges 18. The flanges 18 hence become snugly sandwiched between the pressure plate 35 and the brake plate 31, which plates frictionally engage the opposite surfaces of the flanges 18 to hence prevent slidable displacement of the compressor unit longitudinally of the drawer unit.

When release of the compressor unit is desired, the handle 48 is gripped and pulled upwardly. This raising of the handle 48 is facilitated by the fact that the handles 24 and 48 are vertically spaced apart by a rather small distance, and hence the hand can span these two handles and grip both simultaneously so as to increase the leverage required for raising the handle 48. As handle 48 is lifted, this causes a corresponding lifting of the release member 44, and hence causes the compressor links 42 and 43 to be swung in opposite directions into positions as indicated by dotted lines in FIG. 2. This swinging of the links in opposite directions into a release position causes the arms 51, 51' to relatively swing away from one another, and hence increases the tension within the spring 52. With the handle in its raised position, the wedging surfaces 56, 56' have been swung outwardly away from one another so as to release the pressure on the pressure plate 35, whereupon the compressor body 22 and brake plate 31 can hence move downwardly so as to release the frictional clamping engagement with the flanges 18. With the handle 48 maintained in its raised position, the compressor unit as a whole can then be freely slidably displaced longitudinally of the drawer unit to the desired position. After reaching the desired position, the handle 48 is released, whereupon the spring 52 again returns the compressor links back to their original positions and causes the wedging surfaces 56, 56' to react against the pressure plate 35 so that the compressor body is raised to hence effect frictional clamping of the flanges 18 between the plates 31 and 35.

While the invention illustrates the compressor unit in association with a file drawer of the lateral type, it will be appreciated that this compressor unit is usable on any type file drawer or shelf.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a file unit having a wall, and a compressor unit positioned on the file unit and selectively movably longitudinally therealong;

said wall having channel means fixedly associated therewith and extending longitudinally therealong, said channel means defining therein a longitudinally extending channel which is accessible from the file unit through a longitudinally extending slot, said wall having flange means extending longitudinally along said slot;

said compressor unit including (a) a compressor body positioned on and extending transversely of said file unit, (b) a holding plate positioned within said channel and interconnected to said compressor body for movement therewith longitudinally of said file unit, said holding plate having a first friction surface thereon for engagement with a surface of said flange means, (c) a pressure plate positioned adjacent said wall and interconnected to said compressor body for movement therewith longitudinally of said file unit, said pressure plate having a second friction surface for engaging said wall or said flange means, said first and second friction surfaces facing in opposite directions, (d) means coacting between said holding and pressure plates for permitting relative slidable displacement therebetween in a direction substantially perpendicular to the elongated direction of said channel, said plates being relatively slidable between released and clamping positions, and (e) spring-biased link means coacting between said holding and pressure plates for normally urging said plates into said clamping position, said spring-biased link means including a scissor-type linkage defined by a pair of pivotally-connected links which are relatively pivotal about a pivot axis which extends in substantially parallel relationship to the longitudinal direction of said slot.

2. In combination, a file unit having a wall, and a compressor unit positioned on the file unit and selectively movably longitudinally therealong;

said wall having channel means fixedly associated therewith and extending longitudinally therealong, said channel means defining therein a longitudinally extending channel which is accessible from the file unit through a longitudinally extending slot, said wall having flange means extending longitudinally along said slot;

said compressor unit including (a) a compressor body positioned on and extending transversely of said file unit, (b) a holding plate positioned within said channel and interconnected to said compressor body for movement therewith longitudinally of said file unit, said holding plate having a first friction surface thereon for engagement with a surface of said flange means, (c) a pressure plate positioned adjacent said wall and interconnected to said compressor body for movement therewith longitudinally of said file unit, said pressure plate having a second friction surface for engaging said wall or said flange means, said first and second friction surfaces facing in opposite directions, (d) means coacting between said holding and pressure plates for permitting relative slidable displacement therebetween in a direction substantially perpendicular to the elongated direction of said channel, said plates being relatively slidable between released and clamping positions, and (e) spring-biased link means coacting between said holding and pressure plates for normally urging said plates into said clamping position, said spring-biased link means including a scissor-type linkage defined by a pair of crossed pivotally-connected links having spring means coacting with one ends of said links and having camming surfaces formed on other ends thereof disposed in bearing engagement with said pressure plate for normally urging said pressure plate toward said holding plate in response to the urging of said spring means.

3. A combination according to claim 2, including handle means supported for slidable displacement relative to said compressor body in a direction which is transverse with respect to said wall, said handle means being pivotally connected to said links for activating the latter in response to linear displacement of said handle means.

4. A combination according to claim 3, wherein each of said links includes an arm which projects outwardly from the pivot in a direction which is approximately parallel with said wall, the arms of said links projecting outwardly in opposite direction, and said handle including a yoke structure which includes a pair of legs which project toward said wall and are respectively pivotally connected to said arms adjacent the free ends thereof.

5. A combination according to claim 4, wherein said holding plate is fixedly secured to said compressor body, and wherein said pressure plate is mounted for slidable displacement relative to said compressor body.

6. A combination according to claim 5, wherein said wall comprises a bottom wall.

7. In combination, a file unit having a wall, and a compressor unit positioned on the file unit and selectively movably longitudinally therealong;

said wall having channel means fixedly associated therewith and extending longitudinally therealong, said channel means defining therein a longitudinally extending channel which is accessible from the file unit through a longitudinally extending slot, said wall having flange means extending longitudinally along said slot;

said compressor unit including (a) a compressor body positioned on and extending transversely of said file unit, (b) a holding plate positioned within said channel and interconnected to said compressor body for movement therewith longitudinally of said file unit, said holding plate having a first friction surface thereon for engagement with a surface of said flange means, (c) a pressure plate positioned adjacent said wall and interconnected to said compressor body for movement therewith longitudinally of said file unit, said pressure plate having a second friction surface for engaging said wall or said flange means, said first and second friction surfaces facing in opposite directions, said pressure plate having a horizontal platelike leg which projects rearwardly in the longitudinal direction of said file unit and overlies said flange means so that said flange means is positioned between said holding plate and said horizontal leg, (d) means coacting between said holding and pressure plates for permitting relative slidable displacement therebetween in a direction substantially perpendicular to the elongated direction of said channel, said plates being relatively slidable between released and clamping positions, and (e) spring-biased link means coacting between said holding and pressure plates for normally urging said plates into said clamping position, said spring-biased link means includes a pair of vertically elongated levers which are Pivotally interconnected at a location intermediate their ends to resemble a scissor mechanism, said pivot defining a substantially horizontal axis and being connected to said compressor body, spring means coacting between said levers adjacent the upper ends thereof for normally urging said upper ends to swingably move toward one another, a camming surface defined on each of said levers adjacent the lower end thereof, each said camming surface being of gradually increasing radius as the camming surface projects outwardly in a direction away from the other lever, whereby swinging movement of said levers and of said camming surfaces toward one another in response to the urging of said spring means causes said camming surfaces to engage and exert a downward pressure against the upper surface of said horizontal leg.

8. A combination according to claim 7, wherein said wall comprises a bottom wall, said holding plate being fixedly secured to said compressor body adjacent the lower edge thereof and projecting rearwardly therefrom, said pressure plate being substantially L-shaped and having a vertically portion which overlies and is vertically slidably supported relative to said compressor body.

9. A combination according to claim 8, wherein said spring-biased link means includes a manually-engageable handle member movably supported for vertical displacement adjacent said compressor body and interconnected to said levers for swingably displacing same in opposition to the urging of said spring means.

10. A combination according to claim 9, wherein each said lever includes a central pivot portion whereby said lever is pivotally supported on said compressor body for swinging movement about a substantially horizontal axis, each said lever having three arms which project radially away from said axis, one of said arms being connected to said spring means, another of said arms being pivotally connected to said handle member, and a third arm having said camming surface provided thereon.

11. A combination according to claim 7, including a downwardly-opening yoke-shaped handle member slidably supported for vertical displacement adjacent and relative to said compressor body, said yokelike handle member including a pair of sidewardly-spaced downwardlyprojecting legs which sidewardly straddle said pair of levers, each of said levers having a further arm which is fixedly secured thereto and projects sidewardly thereof from said pivot, said further arms projecting sidewardly in opposite directions, and each of said further arms adjacent the free end thereof being pivotally connected to a respective one of said legs adjacent the lower end thereof.

12. A combination according to claim 11, wherein said compressor body adjacent the upper edge thereof is provided with a sidewardly-projecting hook-like handle thereon, and wherein said handle member adjacent the upper edge thereof is provided with a sidewardly-projecting hook-like handle which is disposed vertically below and slightly spaced from the handle on said compressor body, and a cover plate disposed below the hook-like handle on said handle member, said cover plate being spaced from and extending substantially parallel with said compressor body for enclosing said legs, said levers and said spring means therebetween.

13. In combination, a file unit having a bottom wall, and a compressor unit positioned on the file unit and selectively movable longitudinally therealong;

said wall having channel means fixedly associated therewith and extending longitudinally therealong, said channel means defining therein a longitudinally extending channel which is accessible from the file unit through a longitudinally extending slot, said bottom wall having flange means extending longitudinally along said slot;

said compressor unit including (a) a compressor body positioned within and extending transversely of said file unit, (b) a holding plate positioned within said channel and interconnected to said compressor body for movement therewith longitudinally of said file unit, said holding plate having a friction surface thereon for engagement with said flange means, and (c) manually releasable spring-urged link means coacting between said compressor body and said bottom wall for normally urging said holding plate upwardly into clamping engagement with said flange means, said link means being interconnected to said compressor body for movement therewith longitudinally of said file unit, (d) said link means including a scissor-type linkage defined by a pair of crossed pivotally-connected links having spring means coacting with one ends of said links and having clamping surfaces formed on other ends thereof for normally exerting a downward pressure on said bottom wall for urging the holding plate upwardly into frictional clamping engagement with said flange means, said links being pivotally supported about a pivot axis which extends substantially parallel to the longitudinally extending direction of said slot.

* * * * *